US006267697B1

(12) United States Patent
Sulenta

(10) Patent No.: US 6,267,697 B1
(45) **Date of Patent: *Jul. 31, 2001**

(54) HOCKEY STICK WITH TRIANGULAR HANDLE AND MULTIPLE BENDING PLANES

(76) Inventor: John A. Sulenta, P.O. Box 432, Pinedale, WY (US) 82941

( * ) Notice: Subject to any disclaimer, the term of this patent is extended or adjusted under 35 U.S.C. 154(b) by 0 days.

This patent is subject to a terminal disclaimer.

(21) Appl. No.: 09/383,860

(22) Filed: Aug. 26, 1999

Related U.S. Application Data

(63) Continuation-in-part of application No. 08/994,375, filed on Dec. 19, 1997, now Pat. No. 5,967,913.

(51) Int. Cl.[7] ..... A63B 59/14
(52) U.S. Cl. ..... 473/560
(58) Field of Search ..... 473/560–563, 473/549, 551, 568, 298–300

(56) References Cited

U.S. PATENT DOCUMENTS

| | | | |
|---|---|---|---|
| D. 244,219 | 5/1977 | Poirier . | |
| 2,040,132 | 5/1936 | Hall . | |
| 3,219,348 | 11/1965 | Dishner, Jr. . | |
| 3,586,080 | 6/1971 | Slany . | |
| 3,638,942 | 2/1972 | Bassett . | |
| 4,002,207 | 1/1977 | Bartz . | |
| 4,086,115 | 4/1978 | Sweet, Jr. et al. . | |
| 4,101,125 | 7/1978 | Heath . | |
| 4,445,687 | 5/1984 | Merritt . | |
| 4,600,193 | 7/1986 | Merritt . | |
| 4,969,231 | 11/1990 | Mader et al. . | |
| 5,306,003 | 4/1994 | Pagotto . | |
| 5,423,531 | 6/1995 | Hoshizaki et al. . | |
| 5,577,725 | 11/1996 | Pagotto et al. . | |
| 5,636,836 | 6/1997 | Carroll et al. . | |
| 5,696,339 | 12/1997 | Brennan . | |
| 5,967,913 * | 10/1999 | Sulenta | 473/560 |

FOREIGN PATENT DOCUMENTS

| | | |
|---|---|---|
| 2018138 | 3/1979 | (GB) . |
| 008502691 | 5/1987 | (NL) . |

* cited by examiner

*Primary Examiner*—Mark S. Graham
(74) *Attorney, Agent, or Firm*—Thorpe North & Western, LLP

(57) ABSTRACT

A hockey stick having a handle and a blade wherein the handle is resilient and has at least a portion with a triangular cross section. The handle is configured to deflect out of at least two different bending planes, each parallel with a different side face of the triangular cross section. A distal end of the handle which is coupled to the blade has a rectangular cross section. The handle has a transition section between the rectangular distal end and the triangular portion with a cross section which is partially rectangular and partially triangular.

51 Claims, 11 Drawing Sheets

HOCKEY STICK WITH TRIANGULAR HANDLE AND MULTIPLE BENDING PLANES

This application is a continuation-in-part of Ser. No, 08/994,375 filed Dec. 19, 1997 U.S. Pat. No. 5,967,913, issued Oct. 19, 1999.

BACKGROUND OF THE INVENTION

1. Field of the Invention

The present invention relates to hockey sticks. More particularly, the present invention relates to hockey sticks having a handle with a triangular cross section and at least two different bending planes in which the handle deflects to store energy to be applied to a hockey puck.

2. Prior Art

Ice hockey, street hockey and roller hockey are popular sports played by many people ranging from young children to professional athletes. Street hockey and roller hockey are warmer versions of ice hockey played on non-ice surfaces with in-line skates, or wheeled skates, as opposed to the ice surface and ice skates of ice hockey. Hockey is typically played on enclosed rinks by attempting to shoot a puck through a goal located at either end of the rink, known as a cage. The players wear skates and strike the puck with a stick in order to move it across the rink and into the cage. During play, the puck is often passed back and forth between players and shot at the cages. Accurately passing or shooting the puck with the stick requires a great degree of skill. Therefore, it is important for the player's hockey stick to enhance the player's skill, or at least not unduly interfere or impede the player's ability. In addition, the puck is often shot at the goal with a great deal of force. Therefore, it is important for the player's hockey stick to capably handle the applied forces.

The hockey stick usually has an elongated handle with a grip at a proximal end and a blade at a distal end. The stick is grasped by the player at the grip and at the handle. The blade extends from the handle and has a striking surface used for contacting the puck. The blade is used to guide the puck across the ice as the player skates. In addition, the blade strikes the puck in order to pass the puck to another player or to shot the puck at the goal. The blade is usually formed of wood and may be reinforced with a fiber and epoxy matrix. The blade is also sometimes formed from a plastic material. The handle is also usually formed of wood and may also be reinforced with a fiber and epoxy matrix. The hockey stick typically is provided as an integral unit, with the blade either integrally formed with the handle or otherwise permanently fastened to the handle.

The grip is formed at one end of the handle and wrapped with a tape material for an improved grip. Typically, the grip is little more than an extension of the proximal end of the handle wrapped in tape. Players may hold the handle by the grip with one hand, but usually grasp the handle with both hands, one hand grasping the grip and the other grasping the handle past the grip. In this sense, the entire handle forms the grip of the stick. Passing and shooting the puck usually requires holding the stick with both hands.

The handle is usually formed of an elongated shank or shaft with a rectangular cross section. As mentioned above, the grip is usually nothing more than the proximal end of the handle, and thus shares the same rectangular cross section. The handle, and grip, have four surfaces, two elongated surfaces generally aligned with the blade or the striking surface of the blade, and two shorter surfaces each located between and perpendicular to the longer surfaces. A radius of curvature is formed between each of the surfaces.

In hockey, there are three main types of shots, including the slap shot, the snap shot, and the wrist shot. Each type of shot requires certain performance characteristics from the stick and/or handle, and proper orientation of the grip and handle in the user's hand, and thus proper orientation of the stick and blade to the puck.

The "wrist" shot is considered by many to be the most important shot because it is typically the most accurate. In the wrist shot, the player stands perpendicularly to the goal with the stick cupping the puck behind the back foot. The player moves the puck forwardly on the ice, transferring weight from the back leg to the front leg. As the player follows through the shot, the wrists are quickly reversed, rotating the blade in the direction of the shot. The flicking motion of the wrists shoots the puck off the blade. Thus, with the wrist shot, the proper orientation of the wrist, or the proper orientation of the hand on the handle, is important to reversing, flicking, or breaking the wrist to shoot the puck off the blade. For example, if the player's hands are already gripping the handle in a rotated orientation in the same direction that the player will rotate to shoot, then the amount of further wrist rotation available is limited, and the shot will have less force and speed.

The "snap" shot is a quick release shot used to get a quick shot, such as before the goalie repositions in front of the goal. The snap shot is simply a quick reverse or rotation of the wrist (in either direction). There is no wind-up, as with the wrist shot, but the shot is followed through in the direction of the goal. Again, proper orientation of the wrist, or proper orientation of the hand on the handle, is important for an effective snap shot.

The "slap" shot is generally considered to be the least effective shot because it is less accurate and takes more time to execute, although it looks impressive. The player is oriented perpendicular to the goal and positions the puck near the forward skate. Although a big wind-up is not necessary, the player usually draws the stick back and rotates the trunk and hips to raise the blade as far behind and above as possible. The player then rotates the hips, trunk and shoulders causing the stick to accelerate fowardly and downwardly. The blade contacts the ice behind the puck (1 to 4 inches). The impact of the blade on the ice causes the handle to bend. The player continues to apply pressure on the stick by pushing the lower hand against the handle and holding the grip close to the body. As the handle bows, it stores energy. A good player may bow the handle by approximately two inches. The player continues to move the handle until the blade catches the puck. The energy in the handle is then released causing the puck to accelerate. The player rotates the handle forwardly, turning the blade over until it faces down toward the ice, thus increasing the acceleration of the puck by maintaining force on it.

Thus, an important aspect of the slap shot is the performance characteristics of the stick. The bending or bowing of the handle stores energy. Traditional hockey sticks, with their rectangular cross section, have a single bending plane from which the stick bends or bows. The bending plane is generally parallel with the longitudinal axis of the handle and the blade, and thus parallel with the longer sides of the handle. The rectangular cross section is very similar to structural beams. The stick has a greater dimension, or width, in one direction, much like the larger dimension, or vertical height, of a beam against which a load is applied. Thus, the greater dimension is designed to resist bending, and the stick tends to deflect insignificantly in that direction. The hockey stick, however, has a smaller dimension designed to bow and store energy. The stick deflects significantly in this direction, or out of this plane, defining the single bending plane or direction. In order to take advantage of the bowing design, or energy storing capacity, of the hockey stick, the player must properly orient the stick such that the stick is oriented with respect to the ice and the player so that the applied forces bow the stick.

Players spend a great deal of time practicing the various shots in order to control the orientation of the stick, and thus control the shot of the puck and performance characteristics of the stick. For example, players practice for hours every day to perfect the proper form of the swing and follow through for slap and wrist shots; the proper orientation of the handle and wrist rotation for slap, snap and wrist shots; the proper form, stance and balance transfer for slap and wrist shots; etc.; all in an effort to accurately and quickly deliver the puck to a particular target zone in the goal.

Deviations in the performance of the hockey stick are generally greeted with trepidation as players feel uncomfortable changing their tried and true forms to accommodate a renegade stick design. For example, changing the size or bending characteristics of the stick may affect the shot direction of the puck, and thus the accuracy of the shot. Yet at the same time, it is desirable to have a hockey stick with performance characteristics that enhance the player's ability. For example, different materials have been utilized in fabricating sticks, such as composites, to lighten the stick and increase the energy storing capacity of the stick. Therefore, it is desirable to increase stick performance without altering player performance, such as by altering or tampering with practiced form.

Limited efforts have been directed towards improving hockey stick designs. For example, U.S. Pat. No. 5,636,836, issued Jun. 10, 1997, to Carroll et al. discloses improving the fatigue and deflection properties of a composite hockey stick shaft by limiting the use of reinforcing materials, such as carbon fibers, to only the two sides of the shaft perpendicular with the bending plane, or the short sides, because carbon fibers in the sides of the stick that bend result in lower deflection. Thus, the long sides parallel to the bending plane, and which bend out of the plane, are formed only with layers of glass fiber, while the short sides perpendicular to the bending plane, and which do not bend, are comprised of glass and carbon fiber. Therefore, Carroll teaches placing certain fibers in order to facilitate bending in the single, desired bending plane, while resisting bending in the other, undesirable direction.

As another example, U.S. Pat. No. 5,306,003, issued Apr. 26, 1994, to Pagotto, discloses a hockey stick with two upper edges having a larger radius of curvature than the two lower edges, but maintaining the generally rectangular cross section. As another example, U.S. Pat. No. 5,577,725, issued Nov. 26, 1996, to Pagotto et al. discloses a hockey stick with a handle having different upper and lower gripping zones, each with concave and convex faces, reversed relative to the other, to accommodate each hand of the player. Each zone, however, maintains the generally rectangular cross section with the longer sides having the concave and convex faces.

Therefore, it would be advantageous to develop a hockey stick and/or handle capable of properly orienting the stick in the player's hands so that the shot may be quickly and accurately executed. It would also be advantageous to develop a hockey stick and/or handle capable of properly orienting the stick in the player's hands so that the action of the wrist may be maximized. It would also be advantageous to develop a hockey stick and/or handle capable of maximizing the amount of energy stored, without unduly altering accuracy. It would also be advantageous to develop a handle that conforms more naturally to the player's hand. It would also be advantageous to develop a handle that is comfortable.

OBJECTS AND SUMMARY OF THE INVENTION

It is an object of the present invention to provide a hockey stick or handle configured to properly orient the stick in the player's hand in order to quickly and accurately shoot the puck, and maximize the movement of the player's wrist.

It is another object of the present invention to provide a hockey stick or handle configured to maximize the force storing capability of the stick without unduly altering accuracy.

It is yet another object of the present invention to provide a handle configured for conforming naturally to the player's hand.

These and other objects and advantages of the present invention are realized in a hockey stick and a handle with a triangular cross section. The hockey stick has a blade with a striking surface facing in and defining a forward facing direction.

The handle is an elongated, resilient shaft having a longitudinal axis, a proximal end, and an opposite distal end coupled to the blade. The blade extends from the handle in a transverse direction. The handle has an upper grip section located near the proximal end, and a lower grip section located between the upper grip section and the distal end.

As indicated above, at least a portion of the handle advantageously has a generally triangular cross section including three side faces and three corner edges. In addition, the handle advantageously is configured to deflect with respect to, and out of, each of at least two different bending planes in response to an applied force. Each of the at least two different bending planes extend along the length of the shaft generally parallel with separate side faces of the triangular cross section. The at least two bending planes include first and second bending planes. The first bending plane preferably is oriented generally parallel with a rearward side face of the triangular cross section, and thus generally parallel with the transverse direction. The handle is configured to deflect out of the first bending plane towards the facing direction, as with conventional hockey sticks.

The second bending plane, however, preferably is oriented generally parallel with a downward side face, and thus transverse to both the facing and transverse directions. The handle is configured to deflect out of the second bending plane towards the facing direction and away from the transverse direction, unlike conventional hockey sticks. In addition, the handle may be configured for twisting as the shaft deflects out of the two bending planes, causing the blade to pivot with respect to the longitudinal axis of the handle.

In accordance with one aspect of the present invention, the distal end of the handle has a rectangular cross section, and the handle has a transition section between the rectangular cross section of the distal end and the portion of the handle with the triangular cross section. The transition section has a cross section which is partially rectangular and partially triangular, and forms a gradual transition between the triangular cross section of the handle, and the rectangular cross section of the distal end.

The cross section of the transition section may have four side faces. Two opposite and generally parallel side faces extend from the rectangular cross section of the distal end, while two opposite and angled side faces which are angled with respect to each other extend from the triangular cross section between the parallel side faces. One of the parallel side faces may be concave, and curve outwardly along the length of the shaft in a direction from the distal end towards the triangular cross section.

In accordance with another aspect of the present invention, the triangular cross section has a first circumference, and the transition section has a second circumference which is less than the first circumference to define a flex point.

In accordance with another aspect of the present invention, the upper grip section may have the same or a different cross sectional shape than the triangular cross section of the lower grip section. For example, the upper grip section may have a generally rectangular cross section.

In accordance with another aspect of the present invention, the handle may be selectively coupled to the blade in one of at least two different orientations. In a first orientation, one of the corner edges may be oriented to point generally in the forward facing direction. In a second orientation, one of the side faces may be oriented to face generally in the forward facing direction. In addition, the handle may be coupled to either a right handed blade or a left handed blade, and provide the same orientation of the shaft with respect to either blade.

In accordance with another aspect of the present invention, the hockey stick may include a plug coupled to a proximal end of the shaft and extending the length of the shaft. The plug defines an upper grip section, while the shaft defines a lower grip section.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
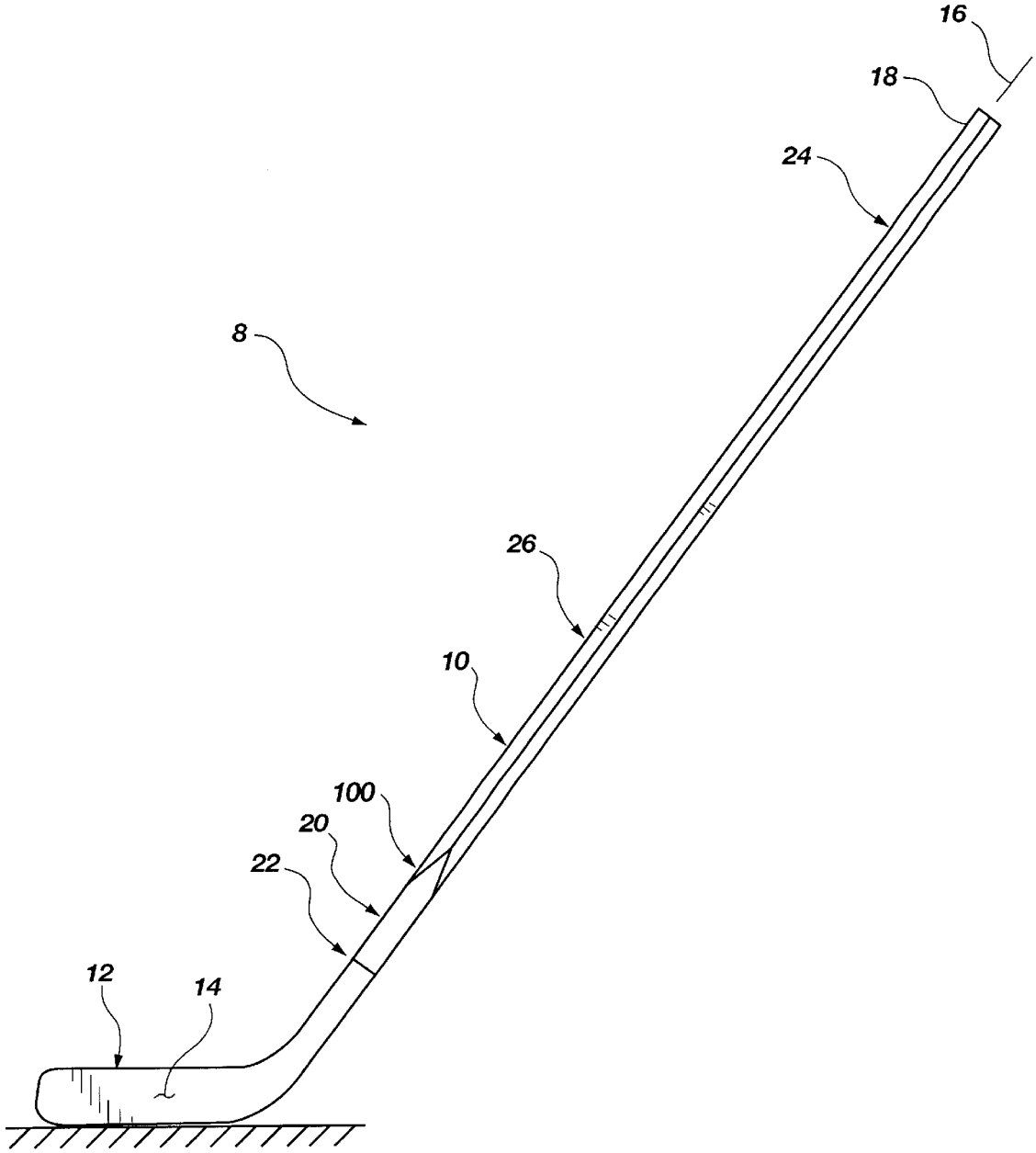
FIG. 1 is a side view of a preferred embodiment of a hockey stick and a handle of the present invention.

As illustrated in FIG. 1, a hockey stick, indicated generally at 8, and a hockey stick handle, indicated generally at 10, of the present invention are shown. The hockey stick 8 has a blade 12 with a striking surface 14 which is adapted for striking a hockey puck. The handle 10 is an elongated shank or shaft with a longitudinal axis 16, and has a proximal end 18, and an opposite distal end 20 coupled to the blade 12 at a connection 22. The handle 10 forms, or defines, an elongated grip extending substantially the entire length of the handle. The grip or handle 10 includes an upper grip section 24 located at the proximal end 18, and a lower grip section 26 located between the upper grip section 24 and the distal end 20 at a middle section of the handle. The term "grip" refers to the handle 10 itself because the stick 8 is typically grasped not only by the proximal end 18 of the handle, but along the length of the handle as well.

Figure 2:
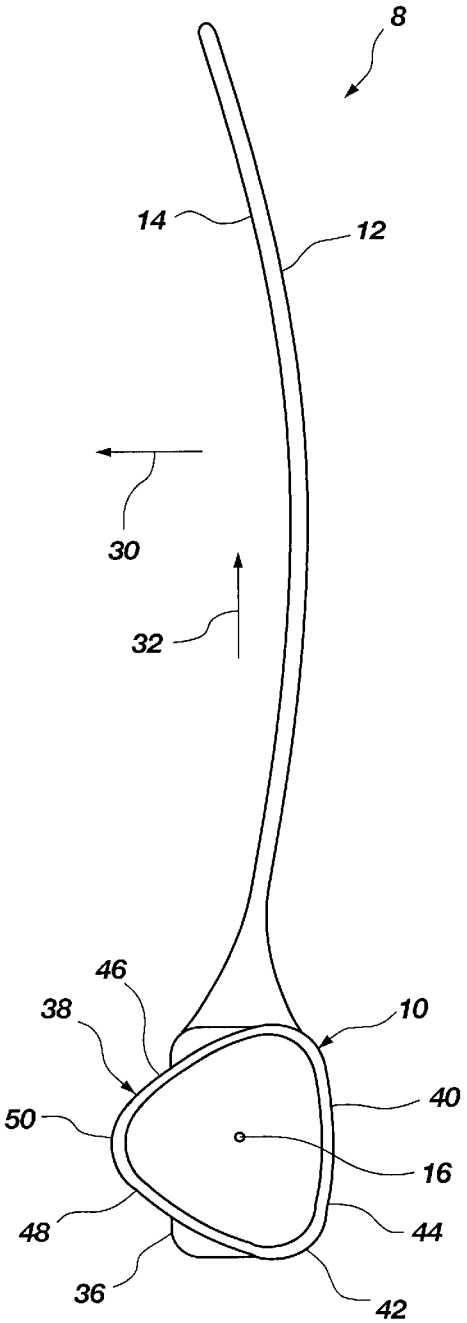
FIG. 2 is an end view of the preferred embodiment of the hockey stick and handle of the present invention.

Referring to FIG. 2, the striking surface 14 of the blade 12 faces in, and defines, a forward direction or forward facing direction, indicated by arrow 30. The blade 12 extends from the handle 10 in a transverse direction, indicated by arrow 32 and the blade itself, with respect to the handle 10 and longitudinal axis 16. The blade 12 may be shaped or curved, as shown, but still extends generally transverse to the handle 10, as represented by arrow 32, and generally perpendicular to the forward direction 30.

Figure 10:
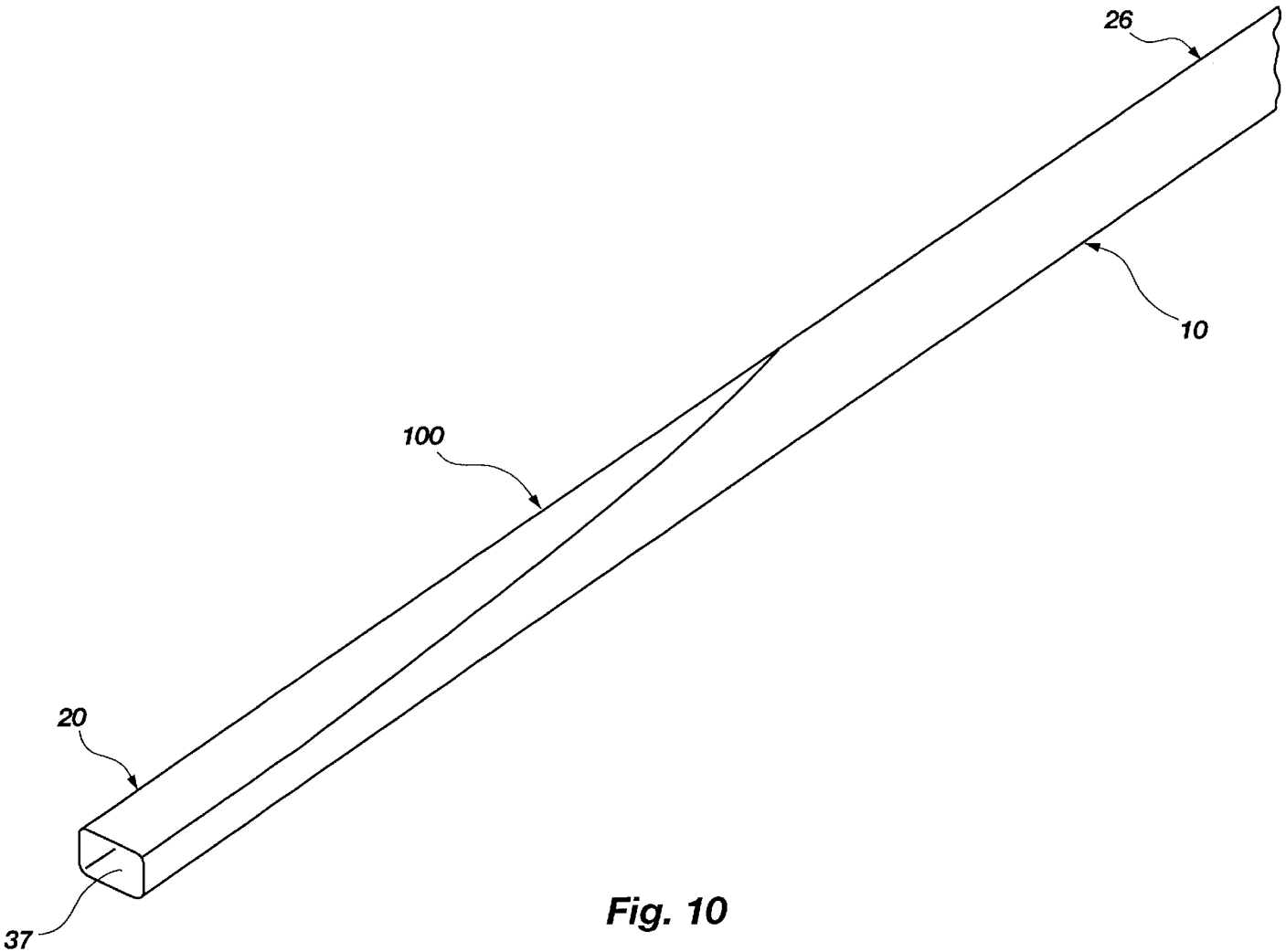
FIG. 10 is a partial perspective view of the preferred embodiment of the handle of the present invention.
Figure 11:
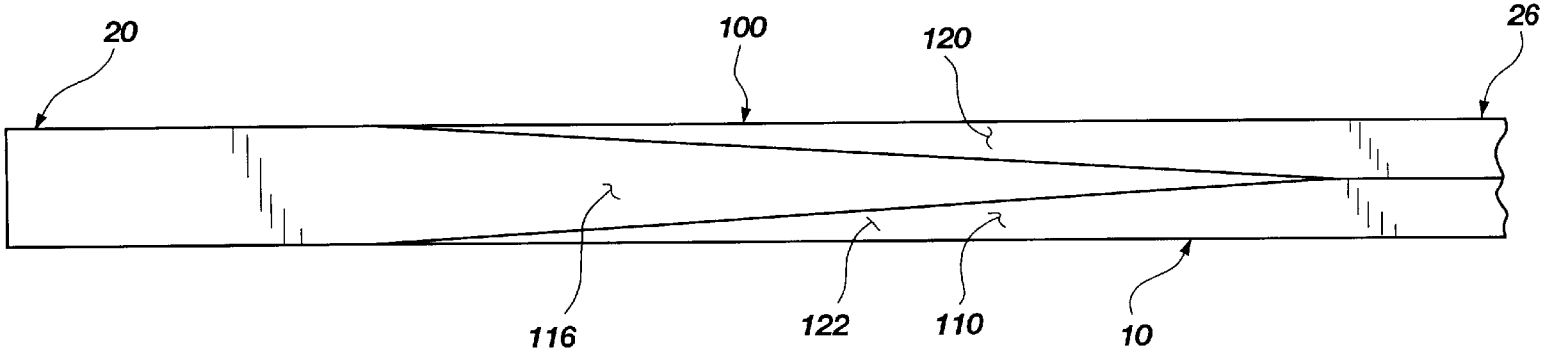
FIG. 11 is a partial side view of the preferred embodiment of the handle of the present invention.
Figure 12:
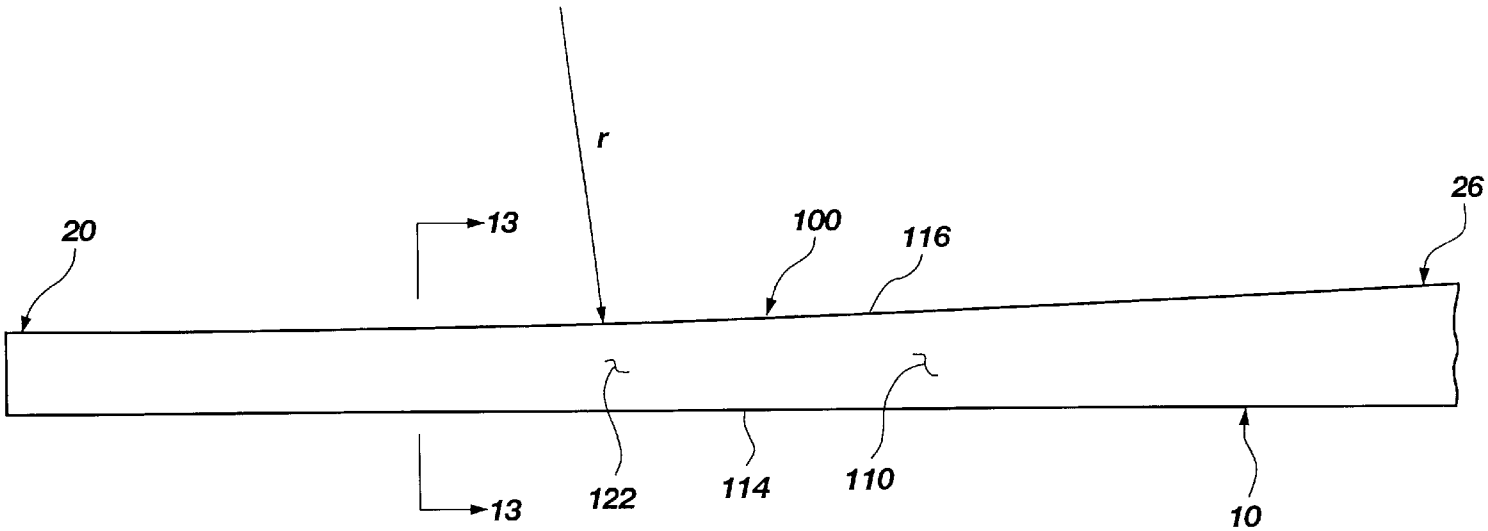
FIG. 12 is a partial top view of the preferred embodiment of the handle of the present invention.

The blade 12 typically has a male protrusion (not shown) with a rectangular cross section for coupling the blade 12 to a handle, as is well known in the art. Referring to FIGS. 1 and 2, the distal end 20 of the handle 10 has a generally rectangular cross section, indicated at 36. The distal end 20 preferably is hollow, or has a cavity, defining a female socket or receiver 37 with a rectangular cross section, as shown in FIG. 10. The socket or receiver 37 receives the male protrusion of the blade 12. An adhesive is usually applied to the protrusion and heated prior to insertion into the socket to secure the blade to the handle. Alternatively, a pin, or like fastener, may extend through the protrusion and socket. Preferably, the distal end 20 has the rectangular cross section with the similar rectangular socket so that the handle 10 may receive standard blades 12.

As illustrated in FIGS. 1 and 2, at least the lower grip section 26 or middle section of the handle 10 advantageously has a generally triangular cross section, indicated at 38 in FIG. 2. The triangular cross section 38 includes three side faces 40 and three corner edges 42. As shown, the handle 10 and blade 12 are configured for a right-handed player.

The blade 12 shown is a right-handed blade. The triangular cross section 38 is oriented with respect to the blade 12 in an orientation believed to be the most preferable for a right-handed player. One of the three side faces 40 is generally oriented to face away from the forward facing direction 30, defining a rearward face 44. The remaining side faces 40 define an upward face 46 facing generally towards the transverse direction 32 and the forward facing direction 30, and a downward face 48 facing generally towards the forward facing direction 30 and away from the transverse direction 32. Similarly, one of the three corner edges 42 is oriented to point in the forward facing direction 30, defining a forward edge 50. It is of course understood that the triangular cross section 38 of the handle 10 may be oriented with respect to the blade 12 to increase comfort or optimize performance. The above described orientation, however, is believed to be the best.

Figure 3B:
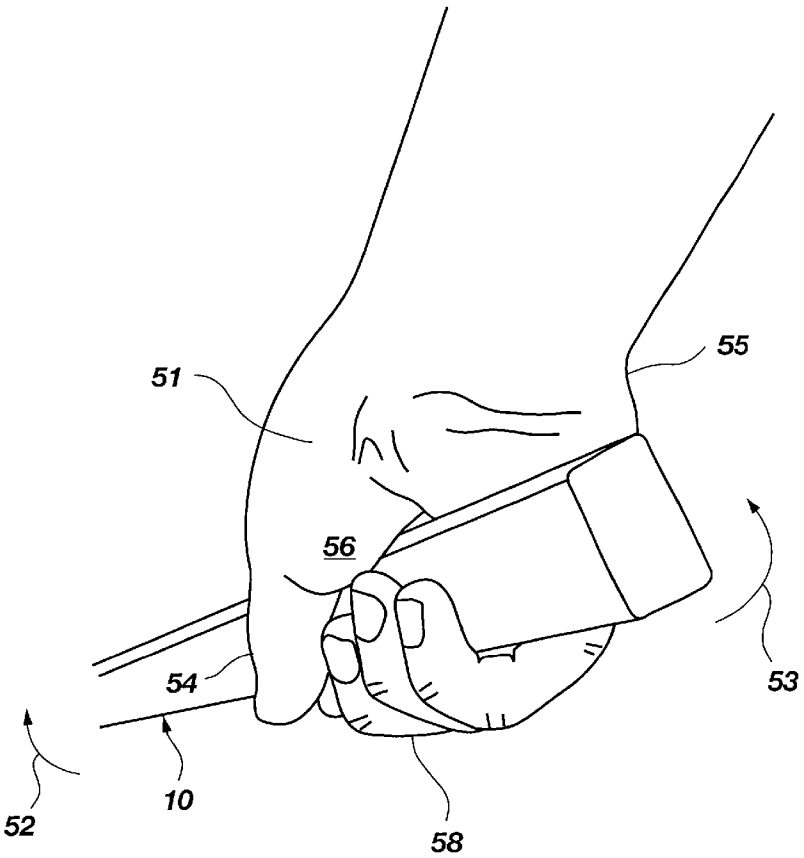
FIG. 3*b* is a partial perspective view of a prior art handle.
Figure 3A:
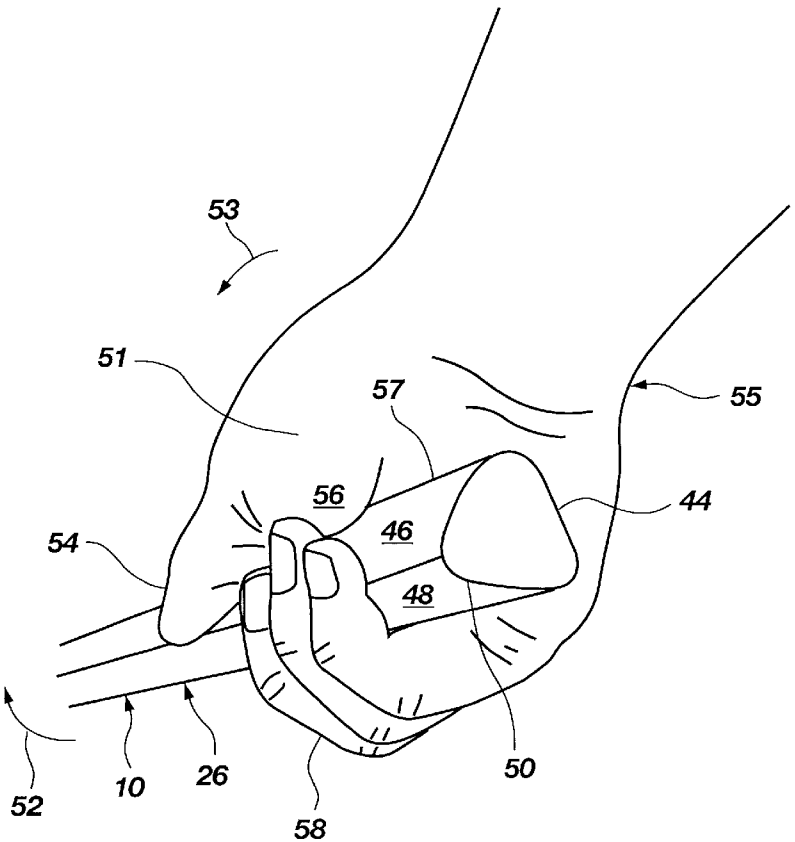
FIG. 3*a* is a partial perspective view of the preferred embodiment of the handle of the present invention.

One advantage of the triangular cross section 38 is that it allows the grip or handle 10 to be held in a proper orientation with respect to the blade 12, and thus the puck. As indicated above, some of the most common shots in hockey, such as the wrist and snap shots, require the player to turn, reverse, flick, or break their wrist to shoot the puck off the blade. Referring to FIG. 3*a*, the handle 10 is shown configured for a right handed player with the player's right hand, indicated at 51, gripping the handle 10, or lower grip portion 26. To perform a wrist shot, the handle 10 is rotated in a direction towards the goal, indicated by arrow 53. The amount of rotation of the handle 10 is extended by the amount of break and rotation of the wrist 55 which turns the hand 51 over towards the goal (indicated by arrow 53), and the initial position of the wrist 55 as the hand 51 grasps the handle 10, or lower grip 26. For example, if the hand 51 grasps the handle 10 in an orientation where the wrist 55 is already rotated in the direction of the shot 53 (the wrist is positioned on top of the handle), then the amount of rotation remaining to shoot the puck is reduced, and the shot will have less force and speed.

The triangular cross section 38, however, advantageously allows the player to grasp the handle 10 with the hand 50 oriented more rearwardly, indicated by arrow 52, or so that the wrist is initially oriented back towards the arm. The orientation of the hand on the triangular handle allows the hand 51 to roll over from the back side of the shaft instead of the top of the shaft, thus adding more rotation or break force. In addition, the triangular cross section 38 naturally positions the player's hand 50 with the thumb 54 and lower palm 56 on the upward face 46 and partially on the edge 50. The rest of the user's palm 57 is positioned on the rearward face 44, while the fingers 58 are positioned on the forward edge 50. Thus, the triangular cross section 38 orients the user's wrist in a more rearwardly rotated position 52, giving the wrist more rotation for the shot, as opposed to the more forwardly rotated 53 position of traditional rectangular handles, as shown in FIG. 3*b*.

Figure 4:
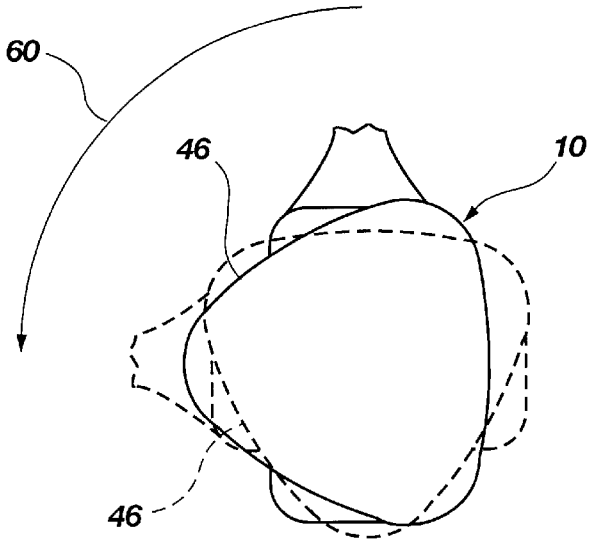
FIG. 4 is a partial end view of the preferred embodiment of the hockey stick and handle of the present invention.
Figure 5:
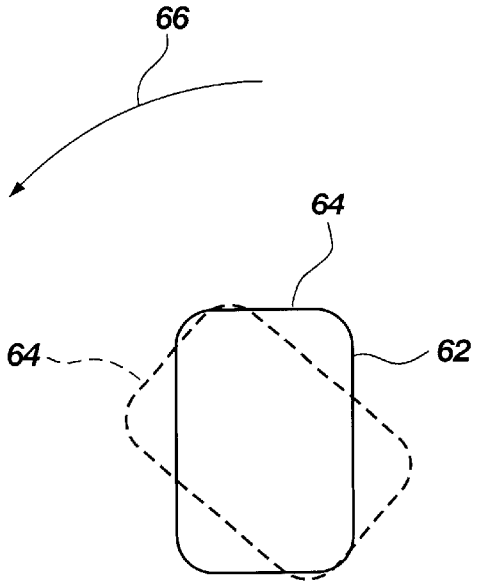
Fig. 5 (PRIOR ART)
FIG. 5 is an end view of a prior art handle.

Referring to FIG. 4, the possible initial orientation of the handle 10 is shown in solid lines, while the possible final orientation of the handle 10 is shown in dashed lines. The amount of rotation is represented by arrow 60. In contrast, FIG. 5 shows a prior art rectangular handle 62 with the possible initial orientation, indicated by solid lines, and the possible final orientation, shown in dashed lines. The amount of rotation of the prior art handle is represented by arrow 66. The triangular handle 10 initially positions the user's hand 51 more rearwardly 52, thus maximizing or increasing the amount of rotation 60 available. Thus, the triangular handle 10 allows the user's wrist more wind-up.

To perform a snap shot, the handle 10 may be rotated in either direction 52 or 53. Referring again to FIGS. 3*a* and 3*b*, the amount of rotation of the handle 10 is extended by the amount of rotation (snap) of the wrist 55, and the initial position of the wrist 55 as the hand 51 grasps the handle 10, or lower grip 26. For example, if the hand 51 grasps the handle 10 in an orientation where the wrist 55 is already rotated in the direction 53 (the wrist on positioned on top of the handle), then the amount of rotation required to snap the wrist is decreased for a forward 53 snap, and is increased for a rearward 52 snap.

The triangular cross section 38, however, advantageously allows the player to grasp the handle 10 with the hand 51 oriented more towards the back of the stick, or so that the wrist 55 is initially oriented back towards the arm. This allows the wrist 55 to snap quickly in either the forward 53 or rearward 52 direction, depending on the type of shot required. The triangular cross section 38 naturally positions the player's hand as described above, giving the wrist 55 quick rotation for the snap shot.

Another advantage of the triangular cross section 38 of the handle 10 is a more natural and comfortable fit in the player's hands. Another advantage of the triangular handle 10 is that less energy is required to grasp or hold the stick to prevent it from turning or rotating in the player's hands. Another advantage of the triangular handle 10 is that it provides a more recognizable orientation with respect to the blade so that the player may be sure of the blade's orientation without having to take his or her eyes off the game.

The side faces 40 of the triangular cross section 38 preferably have a generally curved surface. The curved surface of the faces 40 is preferably slightly convex. The convex faces 40 are raised preferably between 0 and 0.3 inches, and more preferably between 0 and 0.1 inches. The convex faces 40 most preferably have a radius of 1.255 inches. Alternatively, the faces 40 may have a generally planar surface or may be concave. Furthermore, some of the faces may be curved while others are planar, or some may be convex and others concave. Although the side faces 40 may have curved surfaces, the faces 40 generally define planes.

The corner edges 42 of the triangular cross section 38 preferably have a rounded surface. The rounded surface of the edges 42 has a radius of curvature preferably between 0.2 and 0.3 inches, and more preferably 0.267 inches, for the senior model (the junior model will be smaller). Alternatively, the edges 42 may be pointed, chamfered, or beveled. Thus, one or more of the edges 42 may be flat; causing the triangular cross section 38 to have a somewhat trapezoidal cross section, which is intended to be encompassed by the term triangular as used herein. Furthermore, the radius of curvature may be different for some of the edges.

The triangular cross section 38 is preferably equilateral, with all the side faces 40 having the same length, as shown. Alternatively, the triangular cross section may be a right triangle, with two of the side faces being generally perpendicular to one another. Furthermore, the triangular cross section may be isosceles or acute and the sides need not have the same length.

Figure 6:
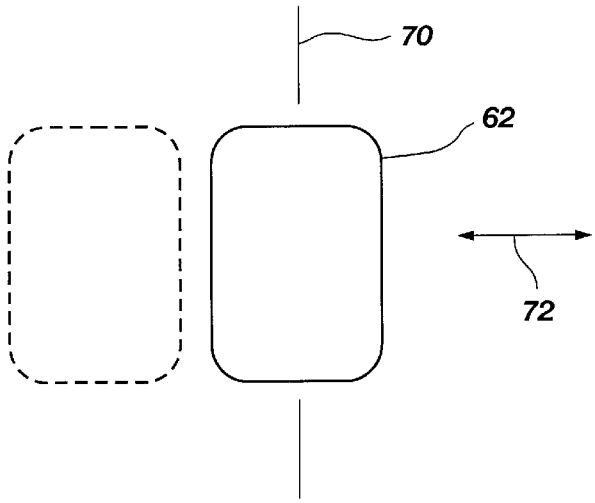
Fig. 6 (PRIOR ART)
FIG. 6 is an end view of a prior art handle.

Referring to FIG. 6, and as indicated above, conventional hockey sticks 62 typically are somewhat flexible and resilient, and configured to bend or bow from an unstressed, initial position, indicated in solid lines, to a stressed or bowed position, indicated in broken lines. The conventional hockey sticks 62 have a single bending plane, indicated at 70, and are configured to bend out of that plane 70 in a single direction, indicated by arrow 72. Bending or bowing the stick 62 stores energy for a shot, such as the slap shot. The bending plane 70 of a typical stick 62 is aligned, or parallel, with the long dimension of the stick 62. Thus, the stick 62 acts much like a beam, resisting movement in the long dimension of the stick 62, or along the plane 70, but allowing movement in the short dimension of the stick 62, or out of the plane 70.

Figure 7:
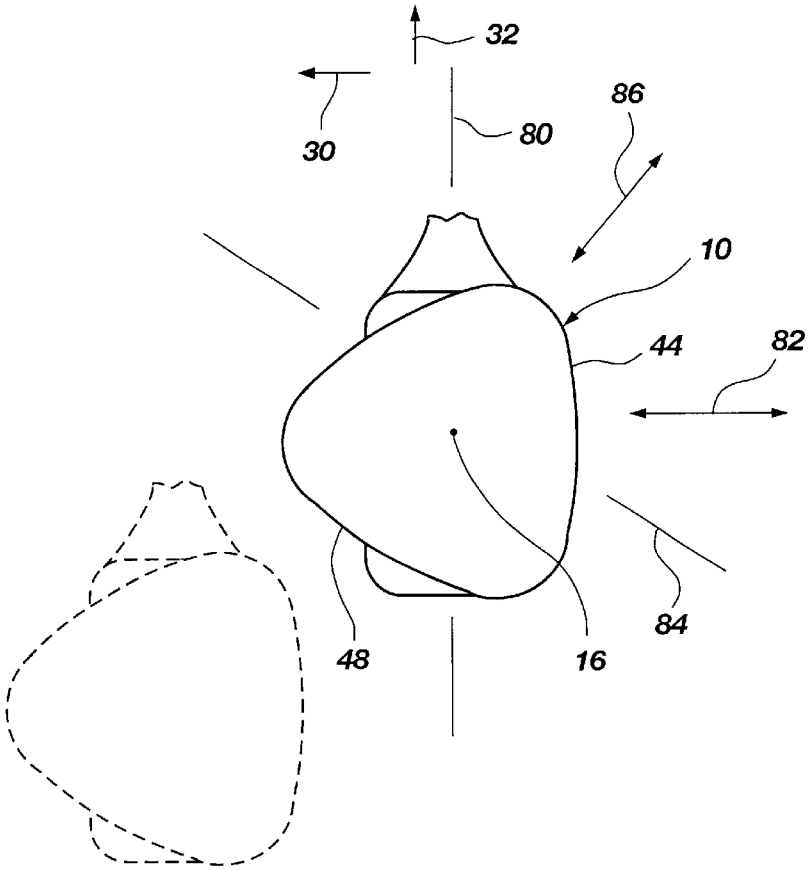
FIG. 7 is a partial end view of the preferred embodiment of the hockey stick and handle of the present invention.
Figure 8:
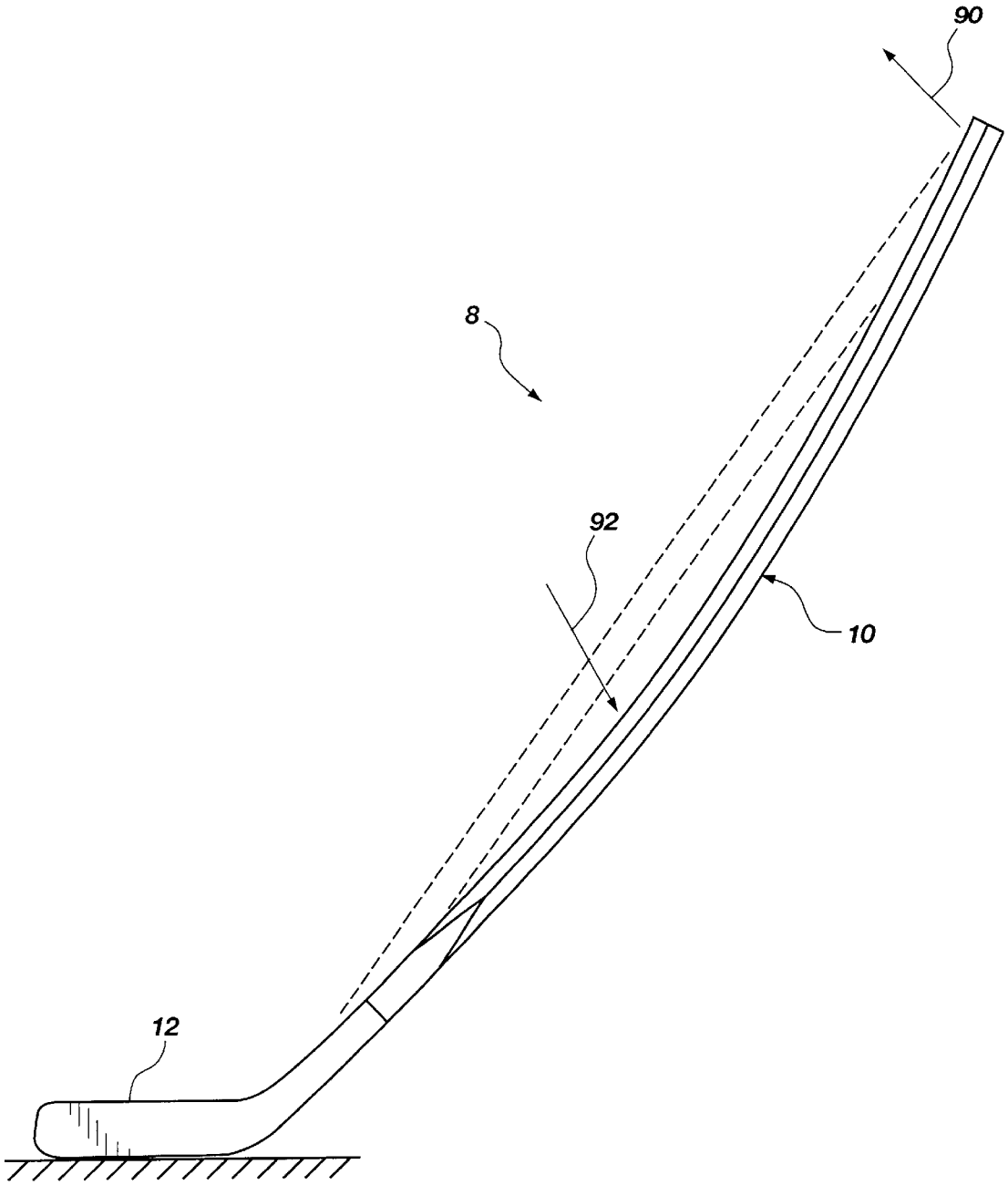
FIG. 8 is a side view of the preferred embodiment of the hockey stick and handle of the present invention.
Figure 9:
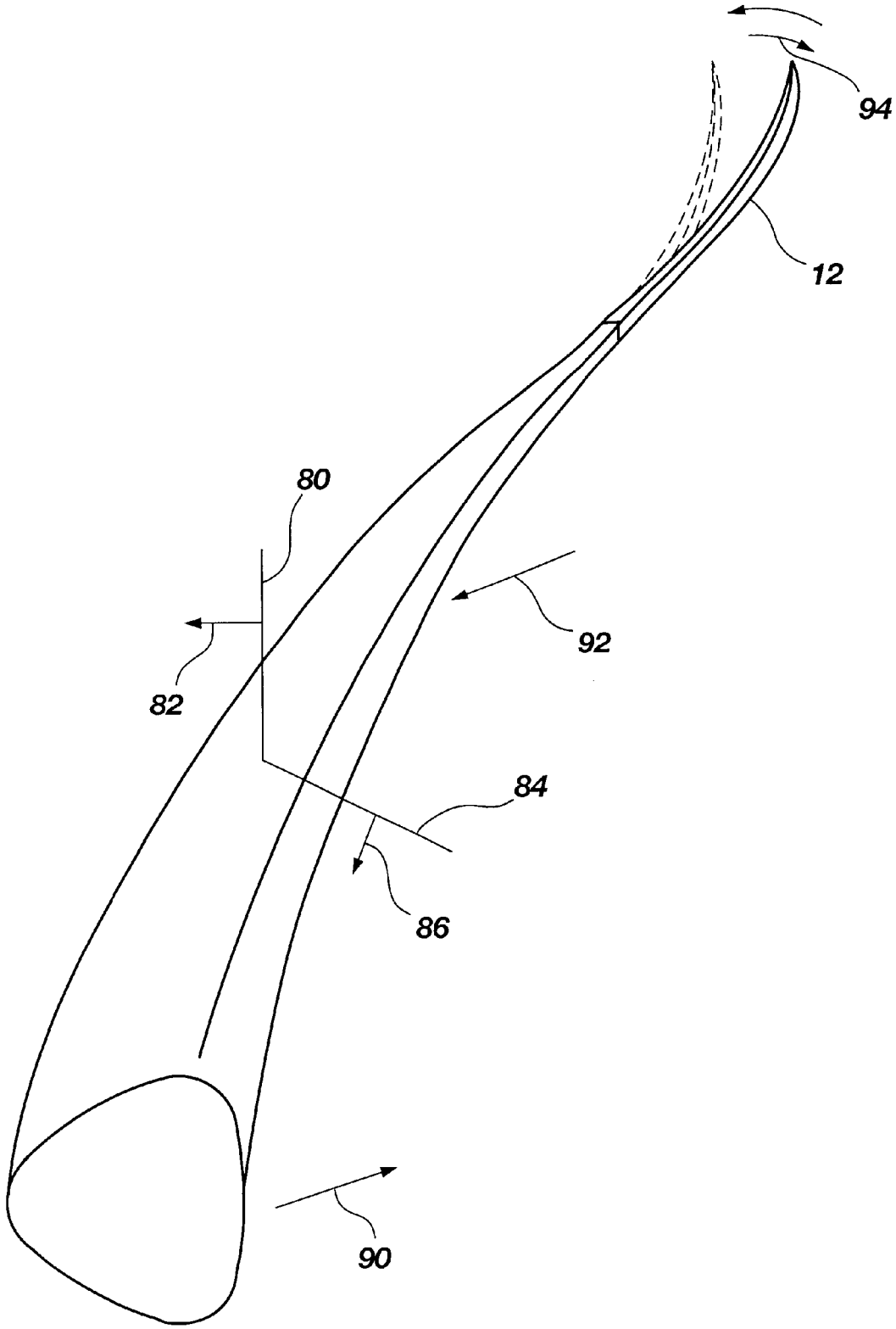
FIG. 9 is a perspective view of the preferred embodiment of the hockey stick and handle of the present invention.

Referring to FIGS. 7–9, the handle 10 of the present invention is resilient, and advantageously is configured to deflect with respect to, and out of, at least two different bending planes, as opposed to a single plane as with the prior art. The triangular cross section 38 of the handle 10 provides multiple bending planes, as opposed to the single bending plane of the rectangular cross section. The bending planes extend along the length of the handle 10 generally parallel with the longitudinal axis 16. Each bending plane is generally parallel with a different side face 40 of the triangular cross section 38.

The bending planes include a first bending plane 80 and a second bending plane 84. Preferably, the bending planes 80 and 84 are oriented to deflect towards the forward facing direction 30, as with conventional hockey sticks, and towards the ground or ice. For the preferred orientation of the triangular cross section of the handle 10 with respect to the blade 12 as described herein, the bending planes 80 and 84 are preferably oriented as described below. The first bending plane 80 preferably is oriented generally parallel with the rearward face 44, and thus generally parallel with the transverse direction 32. Therefore, the handle 10 deflects out of the first bending plane 80 towards the forward facing direction 30, indicated by arrow 82. The second bending plane 84 preferably is oriented generally parallel with the downward face 48, and thus transverse to both the forward facing direction 30 and the transverse direction 32. Therefore, the handle 10 deflects out of the second bending plane 84 generally towards the forward facing direction 30, and generally away from the transverse direction 32, indicated by arrow 86. The handle 10 bends or bows from an unstressed position, indicated in solid lines, out of the two different bending planes 80 and 84 in multiple directions, indicated by arrows 82 and 86, to a bowed position, indicated in broken lines. It should be noted that the triangular cross section and its orientation cause the handle 10 to deflect forwardly 30 and downwardly.

As the player applies force, indicated by arrows 90 and 92 in FIG. 8, to the handle 10, such as during a slap shot, the handle 10 deflects out of multiple bending planes 80 and 84. The player impacts the blade 12 against the ice, while applying force, indicated by arrow 92, on the handle 10 by pushing the lower hand against the middle 26 of the handle 10, and holding the upper handle 24 against the body, indicated by arrow 90. Unlike typical hockey sticks (62 in FIG. 6), the handle 10 of the present invention deflects not only out of the first bending plane 80 in the forward facing direction 30, but also out of the second bending plane 84, as shown in FIG. 8 in solid lines.

Referring to FIG. 9, the stressed or bowed position of the handle 10 is shown. It is believed that the multiple bending planes 80 and 84 cause the blade 12 to pivot backwards, indicated by arrow 94, to a rotated position, indicated by solid lines, from a typical position, indicated by dashed lines. Thus, as the handle 10 bows to store energy, it also twists or pivots to store torque energy. Therefore, the triangular handle 10 of the present invention not only bows to store linear energy, but twists or pivots to store torque energy.

Referring again to FIG. 1, the handle 10 advantageously has a transition section, indicated generally at 100, between the distal end 20, with a rectangular cross section, and the middle portion or lower grip 26, with a triangular cross section. The transition section 100 has a cross section which is partially rectangular and partially triangular, and forms a gradual transition between the triangular cross section of the lower grip 26, and the rectangular cross section of the distal end 20. The cross section of the transition section 100 varies from substantially rectangular to substantially triangular in a direction from the distal end 20 to the proximal end 18. The transition section 100 advantageously provides a smooth and gradual transition between the conventional rectangular distal end 20, and the triangular cross section of the lower grip 26, thus preventing sharp edges which may present potential danger or injury for players.

Referring to FIGS. 10–13, the transition section 100 advantageously preserves the rectangular cross section at the distal end 20 of the handle 10. It is believed that the rectangular cross section at the distal end 20 of the handle 10 advantageously provides further bending or deflection of the handle 10 out of the first bending plane 80, as discussed above, and thus presents additional deflection and energy storage. A substantial portion of the cross section of the transition section 100 has four side faces 110. Two side faces 114 and 116 extend from the rectangular cross section of the distal end 20, and are opposite and generally parallel. One of the opposite and parallel side faces 114 may be the rearward side face 44 of FIG. 2, and may be characterized as extending from the triangular cross section of the lower grip 26, or continuously extending between both cross sections. The other parallel side face 116 preferably faces in the forward facing direction 30, and defines a forward side face. The other two side faces 120 and 122 extend from the triangular cross section of the lower grip 26, and are opposite and angled with respect to one another.

The forward side face 116 gradually transitions from a side face of the rectangular cross section of the distal end 20 to a corner edge, such as forward edge 50 of FIG. 2, of the triangular cross section of the lower grip 26. The forward side face 116 of the transition section 100 maintains a portion of the rectangular cross section near the distal end 20 of the handle 10, and thus increases the deflection of the handle 10 out of the first bending plane 80. The forward side face 116 may extend only through the transition section, or may extend substantially along the length of the handle 10 into the lower grip 26 or middle section and tapper to a width of approximately 0.3 to 0.5 inches causing the triangular lower grip 26 to have a somewhat trapezoidal cross section as indicated above.

In addition, the forward side face 116 preferably is broadly concave, and has a radius of curvature r which lays in a plane defined by the length of the handle 10, as opposed to transverse to the handle. The forward side face 116 curves outwardly along the length of the handle 10 from the distal end 20 towards the proximal end 18. It is believed that the broad radius of curvature r of the forward side face 116 of the transition section 100 accentuates the deflection of the transition section 100 out of the first bending plane 80. In addition, the transition section 100 is preferably between approximately 4 to 12 inches long, which is believed to be sufficient to provide optimal bending. Alternatively, as indicated above, the forward side face 116 may extend into at least the lower grip 26 and taper to a width of between approximately 0.3 to 0.5 inches.

Preferably, the triangular cross section of the lower grip 26 has a circumference of approximately 3.4 inches, while the rectangular cross section of the distal end 20 has a circumference of approximately 3.6 inches. A portion of the transition section 100 advantageously has a circumference of approximately 3.3 inches. Thus, the transition section 100 advantageously has a circumference less than the circumference of the lower grip 26 and/or distal end 20, by approximately 3–8%. The reduced circumference of the transition section 100 advantageously creates a flex point which is more flexible and susceptible to bending. Thus, the flex point, or reduced circumference, focuses the bending or deflection at the transition section 100, which is configured to accentuate the deflection out of the first bending plane 80. It is of course understood that special grips made for younger players may have a smaller circumference, for example 90% smaller than the above, adult circumference. The above dimensions have been found to provide the most comfortable and natural fit for a player's hands. It is of course understood that the above dimensions do not limit the scope of the present invention, but are merely the best dimensions as presently contemplated.

Figure 13:
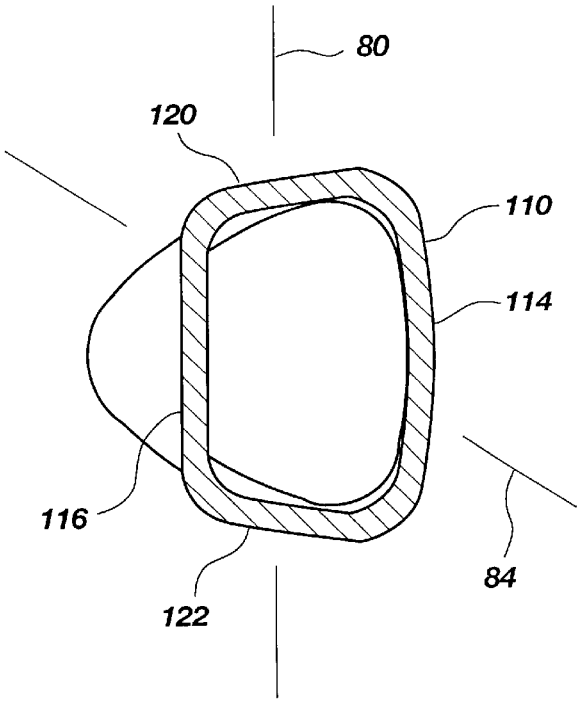
FIG. 13 is a cross sectional view of the preferred embodiment of the handle of the present invention taken along line 13—13 of FIG. 12.
Figure 14:
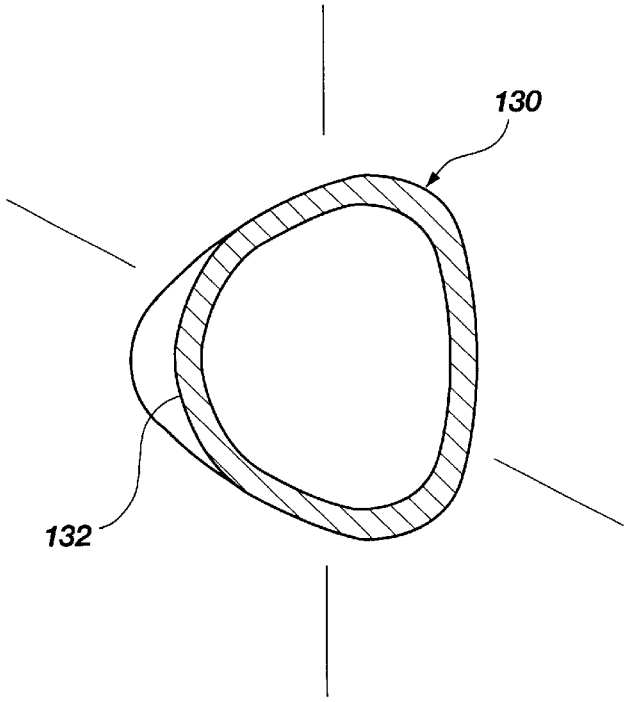
FIG. 14 is a cross sectional view of an alternative embodiment of the handle of the present invention.

In addition to being broadly curved outwardly along the length of the handle, the forward side face 116 preferably is substantially flat in cross section, as shown in FIGS. 13. It is believed that the flat forward side face 116 contributes to the additional bending in the transition section 100. Alternatively, as shown in FIG. 14, a transition section 130 may have a forward side face or corner edge 132 which is rounded, or convex, to further accentuate the triangular cross section and control, or limit, bending in the transition section 130.

Figure 16:
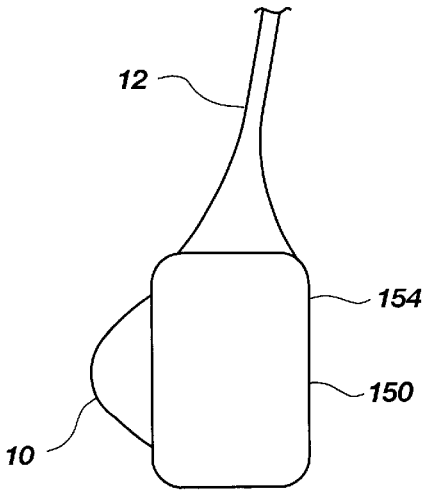
FIG. 16 is a partial end view of the alternative embodiment of the hockey stick and handle of the present invention.
Figure 15:
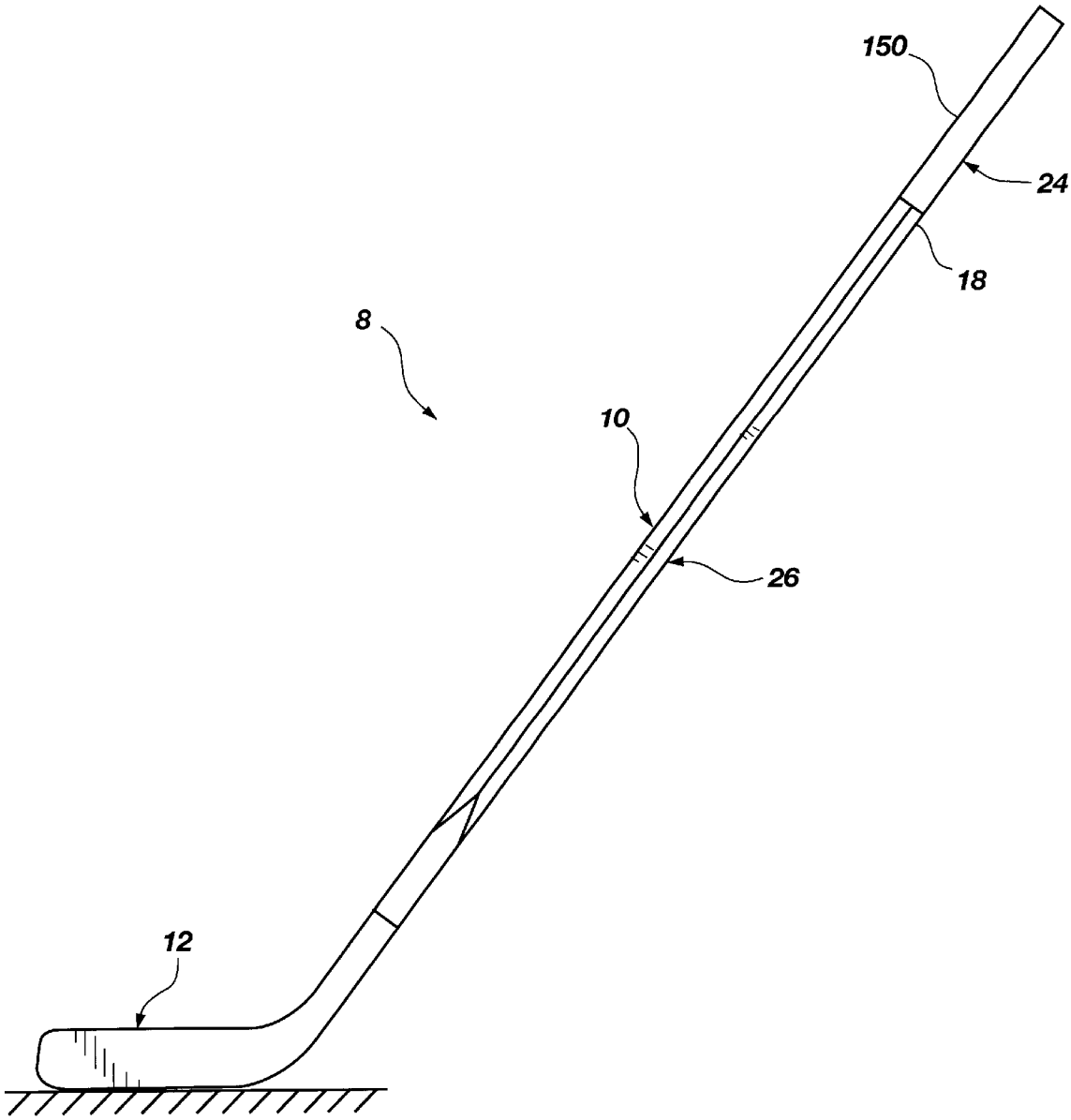
FIG. 15 is a side view of a hockey stick incorporating an alternative embodiment of a handle of the present invention.

Referring again to FIG. 1, the handle 10 may be a single continuous shaft. In addition, a substantial portion of the handle, such as the lower grip 26 and upper grip 24 may have a triangular cross section, as described above. Thus, both the player's hands grasp the handle 10 at an area of triangular cross section. Referring to FIG. 15, the handle 10 is shown with a plug 150 attached to the proximal end 18. The proximal end 18 of the handle 10 is hollow, or has a cavity, much like the distal end 20, except with a triangular cross section. The plug 150 has a male protrusion with a triangular cross section which is received within hollow proximal end 18. The handle 10 may be made of a composite material, and thus may be hollow. The plug 150 may be used to fill the hollow and prevent any sharp corners at the proximal end 18 of the handle. In addition, the plug 150 may be used to extend the length of the handle 10. Thus, the plug 150 forms part of the handle 10, and the proximal end 18. In addition, the plug 150 may define the upper grip 24 of the handle. The plug 150 may have a triangular cross section like the handle 10, and thus create a continuous cross section. Alternatively, the plug 150 may have a rectangular cross section 154, as shown in FIG. 16. The rectangular plug 150 may be used by players who prefer their upper hand to grasp an upper grip 24 with a rectangular cross section. The plug 150 may be secured to the handle 10 much like the blade 12 as described above.

Referring again to FIGS. 1–16, and the above description, the handle 10, or triangular cross section 38, preferably is coupled to the blade 12 so that one of the side faces 40 is a rearward side 44, and is oriented so that it is generally parallel with the blade 12 or transverse direction 32, and facing away from the forward facing direction 30. In addition, one of the corner edges 42 then becomes a forward edge 50, and points or faces in the forward facing direction 30. The handle 10 or triangular cross section 38 may be oriented with respect to the blade 12 as desired, although it is believed that the above described and illustrated configuration is best suited to orient the player's hands for maximum performance and comfort.

Figure 17:
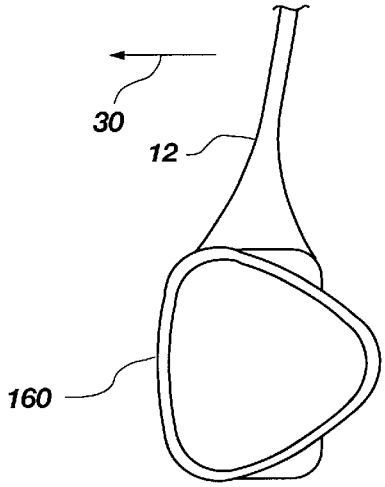
FIG. 17 is a partial end view of an alternative embodiment of a hockey stick and handle of the present invention.

Alternatively, as illustrated in FIG. 17, one of the sides may be a forward side 160 oriented to face in the forward direction 30. Thus, the triangular handle 10 and blade 12 may be selectively coupled in one of at least two different orientations. It is of course understood that the triangular handle 10 may be configured at various different relative angles or rotations to optimize the orientation of the player's hands. In addition, the handle 10 may be coupled to either a left or right handed blade in the same orientation.

In addition, the handle 10 may be adjustably and/or detachably coupled to the blade 12. Thus, the orientation of the handle with respect to the blade may be selectively adjusted. One advantage of a stick with an adjustable grip and/or handle orientation is that the orientation of the grip or handle may be adjusted to meet the particular preferences of the player. Another advantage of the adjustable grip is that players may experiment with the different grip orientations to determine what works best for them.

In addition, it is understood that one of the corner edges 42 of the handle 10 may be relatively flat, forming a handle 10 which is substantially triangular, but which also may be characterized as a trapezoid due to the flat corner edge. Thus, the handle 10 may have a trapezoidal cross-section similar to the cross-sectional shape of the transition section, as shown in FIG. 13.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. A handle for a hockey stick having a blade with a striking surface, the handle comprising:

an elongated shaft having a distal end adapted to be coupled to the blade, the distal end having a generally rectangular cross section, at least a portion of the shaft having a generally triangular cross section including three side faces and three corner edges, and the shaft having a transition section between the portion of the shaft having a generally triangular cross section and the generally rectangular cross section of the distal end, the transition section having a cross section which is partially rectangular and partially triangular forming a gradual transition between the triangular cross section and the rectangular cross section of the distal end.

2. The handle of claim 1, wherein the transition section has a length of approximately 4 to 12 inches.

3. The handle of claim 1, wherein the shaft defines an upper grip section located near a proximal end opposite the distal end and a lower grip section located between the upper grip section and the distal end, wherein the lower grip section has a triangular cross section, and wherein the upper grip section has a generally rectangular cross section.

4. The handle of claim 1, wherein the shaft defines an upper grip section located near a proximal end opposite the distal end and a lower grip section located between the upper grip section and the distal end, and wherein the lower grip section and the upper grip section both have a generally triangular cross section.

5. The handle of claim 1, wherein the striking surface of the blade faces in a forward facing direction; and wherein the shaft is adapted to be selectively coupled to the blade in either one of at least two different orientations including (i) a first orientation in which one of the corner edges is oriented to point generally in the forward facing direction, and (ii) a second orientation in which one of the side faces is oriented to face generally in the forward facing direction.

6. The handle of claim 1, wherein the blade is selected from the group consisting of a right handed blade and a left handed blade; and wherein the shaft is adapted to be selectively coupled to either the right or left handed blade and provides the same orientation of the shaft with respect to either blade.

7. The handle of claim 1, further comprising a solid plug coupled to a proximal end of the shaft, the plug defining an upper grip section and the shaft defining a lower grip section.

8. The handle of claim 1, wherein the cross section of the transition section varies from substantially rectangular to substantially triangular in a direction from the distal end to a proximal end.

9. The handle of claim 1, wherein the cross section of the transition section has four side faces, including two opposite and generally parallel side faces extending from the rectangular cross section of the distal end, and two opposite and angled side faces between the parallel side faces and which are angled with respect to each other and extend from the triangular cross section of the at least a portion of the shaft having a generally triangular cross section.

10. The handle of claim 9, wherein one of the parallel side faces is concave and curves outwardly along the length of the shaft in a direction from the distal end towards the triangular cross section.

11. The handle of claim 1, wherein the cross section of the transition section has three side faces, including two opposite and angled side faces which are angled with respect to each other and extend from the triangular cross section of the at least a portion of the shaft having a generally triangular cross section, and another side face between the angled side faces extending from the rectangular cross section of the distal end; and wherein the cross section of the transition section also has a rounded corner edge between the angled side faces and opposite the other side face.

12. The handle of claim 1, wherein the at least a portion of the shaft having a generally triangular cross section has a first circumference; and wherein a portion of the transition section has a second circumference which is less than the first circumference and defines a flex point.

13. A handle for a hockey stick having a blade with a striking surface, the handle comprising:

an elongated, resilient shaft having (i) a distal end adapted to be coupled to the blade and (ii) a middle section, at least the middle section of the shaft having a generally triangular cross section including three side faces and three corner edges, the shaft being resilient and configured to deflect with respect to, and out of, each of at least two different bending planes in response to an applied force, each of the at least two different bending planes extending along the length of the shaft generally parallel with separate side faces of the triangular cross section.

14. The handle of claim 13, wherein the shaft defines an upper grip section located near a proximal end opposite the distal end and a lower grip section located between the upper grip section and the distal end; wherein the lower grip section has a triangular cross section; and wherein the upper grip section has a generally rectangular cross section.

15. The handle of claim 13, wherein the shaft defines an upper grip section located near a proximal end opposite the distal end and a lower grip section located between the upper grip section and the distal end; and wherein the lower grip section and the upper grip section both have a generally triangular cross section.

16. The handle of claim 13, wherein the striking surface of the blade faces in a forward facing direction; and wherein the shaft is adapted to be selectively coupled to the blade in either one of at least two different orientations including (i) a first orientation in which one of the corner edges is oriented to point generally in the forward facing direction, and (ii) a second orientation in which one of the side faces is oriented to face generally in the forward facing direction.

17. The handle of claim 13, wherein the blade is selected from the group consisting of a right handed blade and a left handed blade; and wherein the shaft is adapted to be selectively coupled to either the right or left handed blade and provides the same orientation of the shaft with respect to either blade.

18. The handle of claim 13, further comprising a plug coupled to a proximal end of the shaft extending the length of the shaft, the plug defining an upper grip section and the shaft defining a lower grip section.

19. The handle of claim 13, wherein the distal end of the shaft has a rectangular cross section; and wherein the shaft has a transition section between the middle section and the distal end, the transition section having a cross section which is partially rectangular and partially triangular forming a gradual transition between the triangular cross section of the middle section and the rectangular cross section of the distal end.

20. The handle of claim 19, wherein the transition section has a length of approximately 4 to 12 inches.

21. The handle of claim 19, wherein the cross section of the transition section has four side faces, including two opposite and generally parallel side faces extending from the rectangular cross section of the distal end, and two opposite and angled side faces between the parallel side faces and which are angled with respect to each other and extend from the triangular cross section of the at least a portion of the shaft having a generally triangular cross section.

22. The handle of claim 21, wherein one of the parallel side faces is concave and curves outwardly along the length of the shaft in a direction from the distal end towards the triangular cross section.

23. The handle of claim 19, wherein the cross section of the transition section has three side faces, including two opposite and angled side faces which are angled with respect to each other and extend from the triangular cross section of the at least a portion of the shaft having a generally triangular cross section, and another side face between the angled side faces extending from the rectangular cross section of the distal end; and wherein the cross section of the transition section also has a rounded corner edge between the angled side faces and opposite the other side face.

24. The handle of claim 19, wherein the at least a portion of the shaft having a generally triangular cross section has a first circumference; and wherein a portion of the transition section has a second circumference which is less than the first circumference and defines a flex point.

25. The handle of claim 13, wherein the at least two different bending planes have an intersection defining an acute angle.

26. A handle for a hockey stick having a blade with a striking surface facing in a forward facing direction, the handle comprising:

an elongated, resilient shaft having a longitudinal axis, a proximal end, and an opposite distal end adapted to be coupled to the blade so that the blade extends in a transverse direction to the longitudinal axis, the shaft having a middle section disposed between the distal and proximal ends defining a lower grip section, at least the middle section of the shaft having a generally triangular cross section including three side faces and three corner edges, the shaft being resilient and configured to deflect with respect to, and out of, at least two different bending planes in response to an applied force, the at least two different bending planes extending along the length of the shaft generally parallel with the longitudinal axis, each bending plane being generally parallel with a separate side face of the triangular cross section, the at least two bending planes including first and second bending planes, the first bending plane being oriented generally parallel with the transverse direction and the shaft being configured to deflect out of the first bending plane towards the facing direction, the second bending plane being oriented transverse to both the facing and transverse directions and the shaft being configured to deflect out of the second bending plane towards the facing direction and away from the transverse direction.

27. The handle of claim 26, wherein the shaft defines an upper grip section located near the proximal end, and wherein the upper grip section has a generally rectangular cross section.

28. The handle of claim 26, wherein the shaft defines an upper grip section located near the proximal end, and wherein the upper grip section has a generally triangular cross section.

29. The handle of claim 26, wherein the shaft is adapted to be selectively coupled to the blade in either one of at least two different orientations including (i) a first orientation in which one of the corner edges is oriented to point generally in the forward facing direction, and (ii) a second orientation in which one of the side faces is oriented to face generally in the forward facing direction.

30. The handle of claim 26, wherein the blade is selected from the group consisting of a right handed blade and a left handed blade; and wherein the shaft is adapted to be selectively coupled to either the right or left handed blade and provides the same orientation of the shaft with respect to either blade.

31. The handle of claim 26, further comprising a plug coupled to the proximal end of the shaft, the plug defining an upper grip section and the shaft defining the lower grip section.

32. The handle of claim 26, wherein the distal end of the shaft has with a rectangular cross section; and wherein the shaft has a transition section between the middle section and the distal end, the transition section having a cross section which is partially rectangular and partially triangular forming a gradual transition between the triangular cross section of the middle section and the rectangular cross section of the distal end.

33. The handle of claim 32, wherein the transition section has a length of approximately 4 to 12 inches.

34. The handle of claim 32, wherein the triangular cross section is oriented with respect to the blade with one of the three side faces being generally parallel with the transverse direction defining a rearward face adapted for receiving a palm of a user's hand, and one of the three corner edges generally pointing in the forward facing direction defining a forward edge, the remaining side faces defining an upward side face facing in the transverse direction and the forward facing direction, and a downward side face facing in the facing direction and away from the transverse direction; and wherein the first bending plane is oriented generally parallel with the rearward face and the second bending plane is oriented generally parallel with the downward face.

35. The handle of claim 32, wherein the shaft is configured for twisting as the shaft deflects out of the at least two bending planes causing the blade to pivot with respect to the longitudinal axis.

36. The handle of claim 32, wherein the cross section of the transition section has four side faces, including two opposite and generally parallel side faces extending from the rectangular cross section of the distal end, and two opposite and angled side faces between the parallel side faces and which are angled with respect to each other and extend from the triangular cross section of the at least a portion of the shaft having a generally triangular cross section.

37. The handle of claim 36, wherein one of the parallel side faces is concave and curves outwardly along the length of the shaft in a direction from the distal end towards the triangular cross section.

38. The handle of claim 32, wherein the cross section of the transition section has three side faces, including two opposite and angled side faces which are angled with respect to each other and extend from the triangular cross section of the at least a portion of the shaft having a generally triangular cross section, and another side face between the angled side faces extending from the rectangular cross section of the distal end; and wherein the cross section of the transition section also has a rounded corner edge between the angled side faces and opposite the other side face.

39. The handle of claim 32, wherein the at least a portion of the shaft having a generally triangular cross section has a first circumference; and wherein a portion of the transition section has a second circumference which is less than the first circumference and defines a flex point.

40. A hockey stick comprising:

a blade having a striking surface defining a forward facing direction; and an elongated, resilient handle having a longitudinal axis, a proximal end, and an opposite distal end coupled to the blade, the blade extending from the handle in a transverse direction, the handle defining an upper grip section located near the proximal end and a lower grip section located between the upper grip section and the distal end, at least a portion of the lower grip section of the handle having a generally triangular cross section including three side faces and three corner edges, the triangular cross section being oriented with respect to the blade with one of the three side faces being oriented to face away from the forward facing direction defining a rearward face adapted for receiving a palm of a user's hand, and one of the three corner edges being oriented to point in the forward facing direction defining a forward edge, the remaining side faces defining an upward face facing in the transverse direction and the forward facing direction, and a downward face facing in the forward facing direction and away from the transverse direction, the handle being resilient and configured to deflect with respect to, and out of, at least two different bending planes extending along the length of the handle generally parallel with the longitudinal axis including first and second bending planes, the first bending plane being oriented generally parallel with the rearward face and the second bending plane being oriented generally parallel with the downward face.

41. The hockey stick of claim 40, wherein the upper grip section has a generally rectangular cross section.

42. The hockey stick of claim 40, wherein the upper grip section has a generally triangular cross section.

43. The hockey stick of claim 40, wherein the blade is selected from the group consisting of a right handed blade and a left handed blade; and wherein the handle is selectively coupled to either the right or left handed blade and provides the same orientation of the handle with respect to either blade.

44. The hockey stick of claim 40, wherein the handle comprises a plug coupled to the proximal end of the handle, the plug defining the upper grip section and the handle defining the lower grip section.

45. The hockey stick of claim 40, wherein the distal end of the handle has a rectangular cross section; and wherein the handle has a transition section between the lower grip section and the distal end, the transition section having a cross section which is partially rectangular and partially triangular forming a gradual transition between the triangular cross section of the lower grip section and the rectangular cross section of the distal end.

46. The hockey stick of claim 45, wherein the transition section has a length of approximately 4 to 12 inches.

47. The hockey stick of claim 45, wherein the cross section of the transition section has four side faces, including two opposite and generally parallel side faces extending from the rectangular cross section of the distal end, and two opposite and angled side faces which are angled with respect to each other and extend from the triangular cross section of the at least a portion of the handle having a generally triangular cross section.

48. The hockey stick of claim 47, wherein one of the parallel side faces is concave and curves outwardly along the length of the handle in a direction from the distal end towards the triangular cross section.

49. The hockey stick of claim 46, wherein the cross section of the transition section has three side faces, including two opposite and angled side faces which are angled with respect to each other and extend from the triangular cross section of the at least a portion of the handle having a generally triangular cross section, and another side face between the angled side faces extending from the rectangular cross section of the distal end; and wherein the cross section of the transition section also has a rounded corner edge between the angled side faces and opposite the other side face.

50. The hockey stick of claim 46, wherein the at least a portion of the handle having a generally triangular cross section has a first circumference; and wherein a portion of the transition section has a second circumference which is less than the first circumference and defines a flex point.

51. The hockey stick of claim 40, wherein the two different bending planes have an intersection defining an acute angle.

* * * * *